United States Patent [19]

Komaita et al.

[11] Patent Number: 4,628,025

[45] Date of Patent: Dec. 9, 1986

[54] POLYESTER SUPPORT FOR PHOTOGRAPHIC USE

[75] Inventors: Toshiki Komaita; Takanori Nakadate; Yoshiyuki Funabashi; Kazuto Kiyohara, all of Tokyo, Japan

[73] Assignee: Konishiroku Photo Industry Co., Ltd., Japan

[21] Appl. No.: 754,258

[22] Filed: Jul. 12, 1985

[30] Foreign Application Priority Data

Jul. 13, 1984 [JP] Japan ..... 49-146324

[51] Int. Cl.[4] ..... G03C 1/76

[52] U.S. Cl. ..... 430/533; 430/528; 528/183

[58] Field of Search ..... 430/533, 528; 528/183

[56] References Cited

U.S. PATENT DOCUMENTS 3,918,976 11/1975 Arai et al. ..... 430/533

3,948,664 4/1976 Okuyama et al. ..... 430/533

4,255,516 3/1981 Katoh et al. ..... 430/533

*Primary Examiner*—Jack P. Brammer

*Attorney, Agent, or Firm*—Finnegan, Henderson, Farabow, Garrett & Dunner

[57] ABSTRACT

A support for photographic use comprising a polyester film is disclosed which contains at least one compound of the following formula (I) and at least one quaternary ammonium salt of the following formula (II):

(I)

-continued (wherein A is —NH— ; $R_1$, $R_2$, $R_3$, $R_5$, $R_4$)

B, C and D are each —NH— ; $R_1$, $R_2$, $R_3$, $R_5$, $R_4$ a hydroxyl group, a nitro group, an amino group or a hydrogen atom; $R_1$, $R_2$, $R_3$, $R_4$ and $R_5$ are each a hydrogen atom, a halogen atom, an alkoxy group, an alkyl group, an aryloxy group, an aralkoxy group, a hydroxyalkyl group, $-(OCH_2)_mOH$ (m is an integer or 1 to 4) or B, C and D are not simultaneously at least one member selected from the group consisting of a hydrogen atom, a nitro group and an amino group);

(II)

(wherein $R_6$, $R_7$, $R_8$ and $R_9$ are each an alkyl group, an aralkyl group or an allyl group; X is an anion; and n represents the number of charges on X).

7 Claims, No Drawings

POLYESTER SUPPORT FOR PHOTOGRAPHIC USE

BACKGROUND OF THE INVENTION

1. Field of the Invention

The present invention relates to a support for photographic use, and more particularly, to a polyester film of such type which is adapted to X-ray photographic film supports.

2. Description of the Prior Art

Polyester films used as supports for X-ray photographic films are usually colored to provide a blue or bluish purple color in order to render the image on the photographic film easily discernible and to minimize the eye strain of the viewer observing the image on a viewing lantern.

Ordinary blue or bluish purple films have a spectrum of shades ranging from red to green and may be light or dark. However, for the reasons peculiar to supports for use in X-ray photography, the films designed for use as such supports are required to have a very limited range of color tones. Japanese Patent Publication No. 8734/1972 disclosed the preferred chromaticity range for polyethylene terephthalate films used as supports for X-ray photographic films.

As evidenced by British Pat. No. 1,137,595, Belgian Pat. No. 715,614 and Japanese Patent Publication No. 33724/1976, the conventional efforts made to obtain the desired blue or bluish purple color in polyester films for X-ray photographic film supports have centered around the screening of colorants. On the other hand, because of the extremely stable physical structure of polyester films, it is difficult to color them uniformly by such techniques as solvent coloring and surface coating. Instead, bulk coloring techniques which are to incorporate organic coloring agents into the base are more commonly employed, wherein a colorant is dispersed or dissolved in the polyester being synthesized or incorporated into the polymer being melt-formed. If one or more colorants alone are introduced into the polyester, variations in color shade occur unavoidably while the polymer is processed into a film under the conventional polyester film forming conditions. Yellowish films shades are particularly objectionable because they render the photographic image less easily discernible and cause increased straining of the viewer's eye.

Unexamined Published Japanese Patent Application No. 734/1980 discloses a Color Index Solvent Blue 97 as a colorant that suffers a smaller variation in color at any stage of the film production, but even this colorant is not completely effective in solving the problems associated with polyester films intended for use as supports for X-ray photographic films.

The present inventors made various studies to attain the purpose of producing a colored polyester film for X-ray photographic film supports having a stabilized color tone without experiencing any variation in color at any stage of the film production. As a result, the inventors have found that if not only a colorant but also a quaternary ammonium salt is incorporated in a polyester, a film having the desired color can consistently be produced without experiencing any change in color during the process of film production.

SUMMARY OF THE INVENTION

One object, therefore, of the present invention is to provide a support for X-ray photographic use that has a desired color hue.

Another object of the invention is to provide such colored film by processing a polyester shaded to a blue or bluish purple color by bulk coloring into a film by melt extrusion techniques without experiencing any color change at any stage of the film processing.

The stated objects of the present invention can be accomplished by a support for photographic use comprising a polyester film containing at least one compound of the following formula (I) and at least one quaternary ammonium salt of the following formula (II):

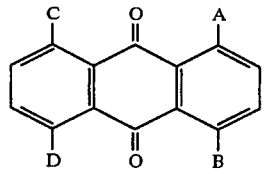

(I)

wherein A is

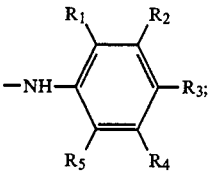

B, C and D are each

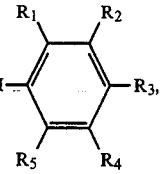

a hydroxy group, a nitro group, an amino group or a hydrogen atom; $R_1$, $R_2$, $R_3$, $R_4$ and $R_5$ are each a hydrogen atom, a halogen atom, an alkoxy group, an alkyl group, an aryloxy group, an aralkoxy group, a hydroxyalkyl group, $-(OCH_2)_mOH$ (wherein m is an integer of 1 to 4) or

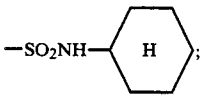

B, C and D are not simultaneously at least one member selected from the group consisting of a hydrogen atom a nitro group and an amino group (i.e., B, C and D are not the same or different atoms or groups selected from the group consisting of hydrogen, nitro and amino);

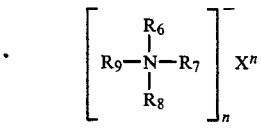

(II)

where $R_6$, $R_7$, $R_8$ and $R_9$ are each an alkyl group, an aralkyl group or an allyl group; X is an anion; and n represents the number of charges on X).

The present invention is hereunder described in detail.

The alkyl group denoted by B, C, D, $R_1$, $R_2$, $R_3$, $R_4$ and $R_5$ in formula (I) may be the same or different and it may be a straight chain, a branched chain or a ring. This also holds true with the alkyl portion of each of the alkoxy and hydroxyalkyl groups denoted by $R_1$, $R_2$, $R_3$, $R_4$ and $R_5$ in formula (I). Preferred alkyl groups have 1 to 6 carbon atoms and are illustrated by methyl, ethyl, iso-propyl, n-butyl, sec-butyl, tert-butyl, n-amyl and cyclohexyl.

The alkoxy and aralkoxy groups represented by $R_1$, $R_2$, $R_3$, $R_4$ and $R_5$ may have a substituent. An illustrative substituent on the alkoxy group is a phenyl group which may have a substituent such as a halogen atom or an alkyl group. An exemplary substituent on the aralkoxy group is an alkyl group which may have a substituent such as a halogen atom or a phenyl group.

The alkyl group denoted by $R_6$, $R_7$, $R_8$ and $R_9$ in formula (II) may be the same or different and it may be a straight chain, a branched chain or a ring. Preferred alkyl groups have 1 to 20 carbon atoms and are illustrated by methyl, ethyl, iso-propyl, n-butyl, sec-butyl, tert-butyl, n-amyl, iso-amyl, hexyl, octyl, nonyl, decyl, dodecyl, cecyl and cyclohexyl.

Specific but non-limiting examples of the compounds of formula (I) are listed below.

(I-1)

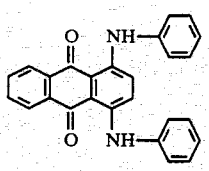

(I-2)

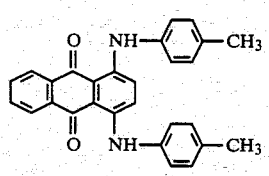

(I-3)

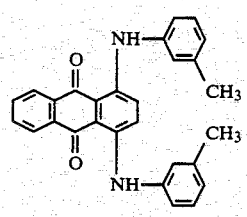

(I-4)

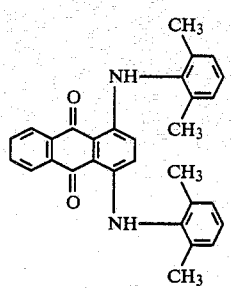

-continued (I-5)

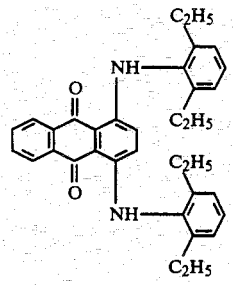

(I-6)

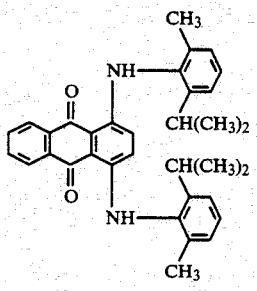

(I-7)

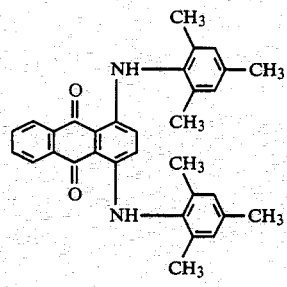

(I-8)

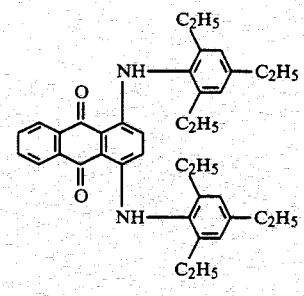

(I-9)

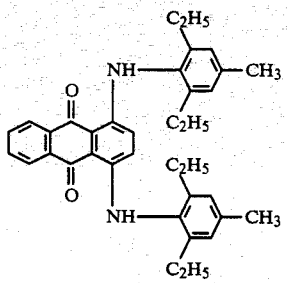

-continued
(I-10)
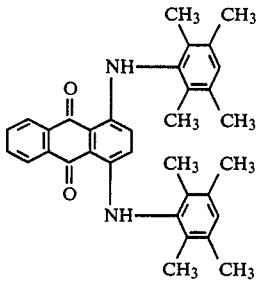
(I-11)
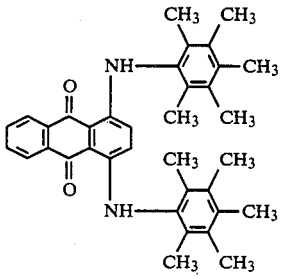
(I-12)
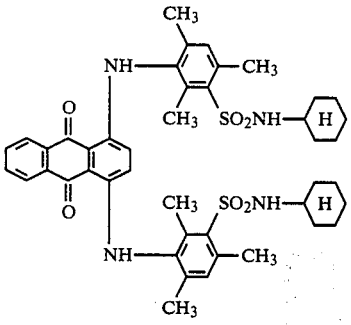
(I-13)
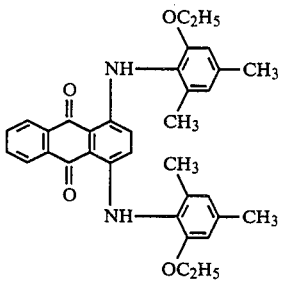
(I-14)
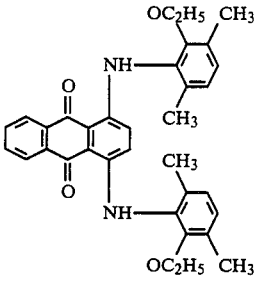
-continued
(I-15)
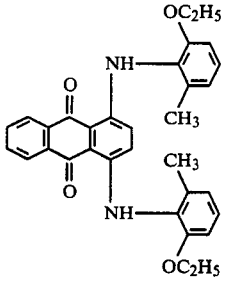
(I-16)
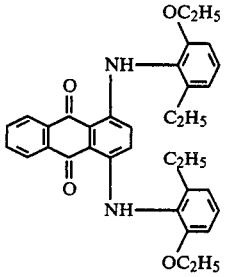
(I-17)
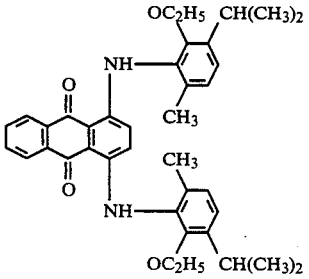
(I-18)
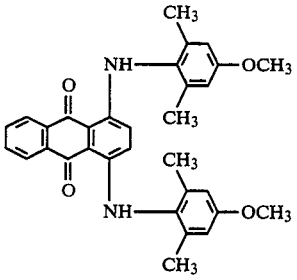
(I-19)
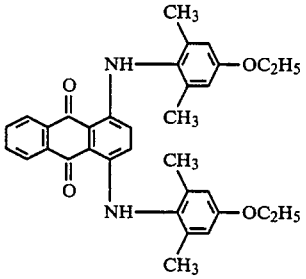
(I-20)
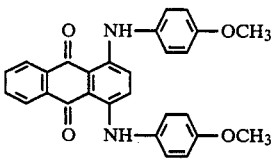

-continued
(I-21)
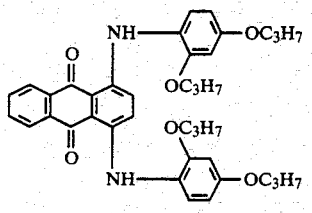
(I-22)
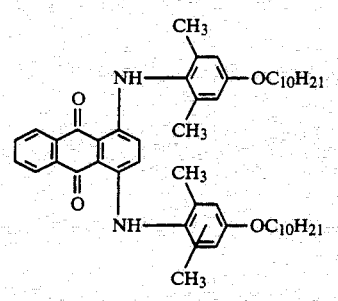
(I-23)
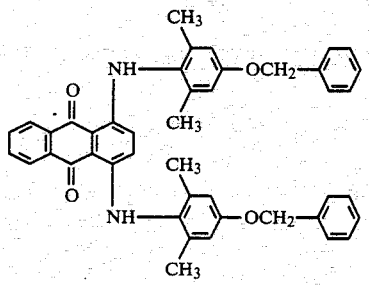
(I-24)
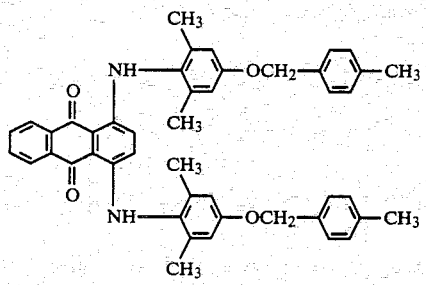
(I-25)
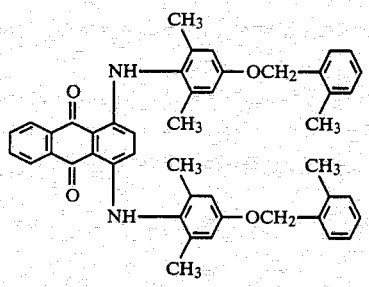
(I-26)
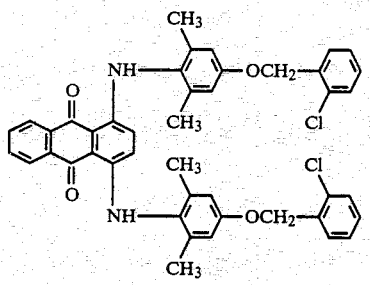
-continued
(I-27)
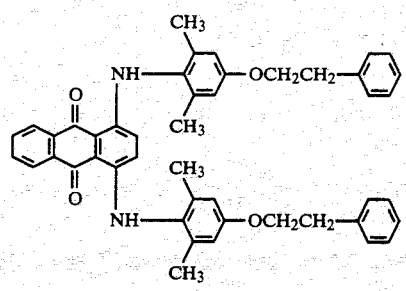
(I-28)
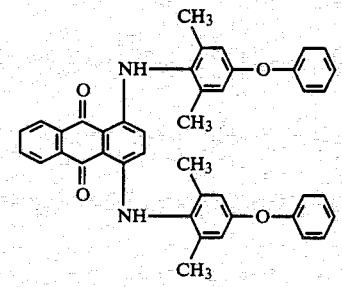
(I-29)
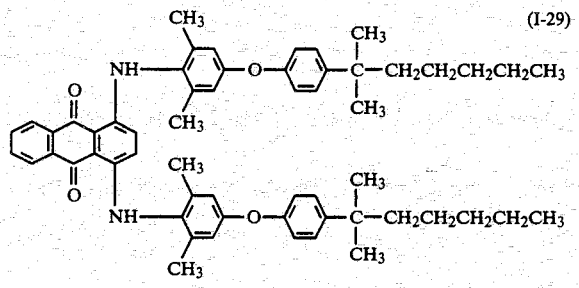
(I-30)
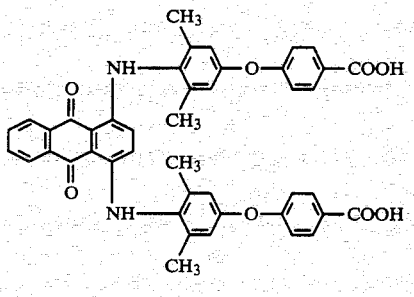
(I-31)
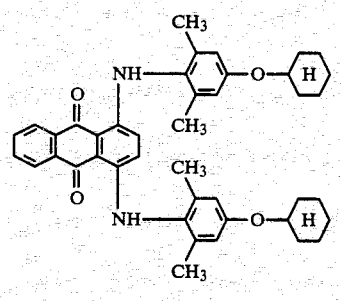

-continued
(I-32)
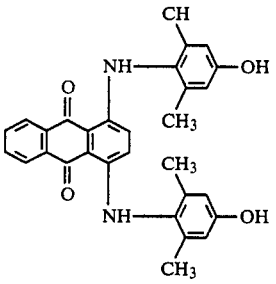
(I-33)
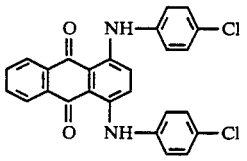
(I-34)
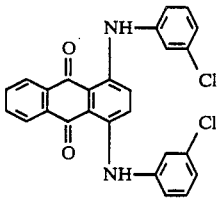
(I-35)
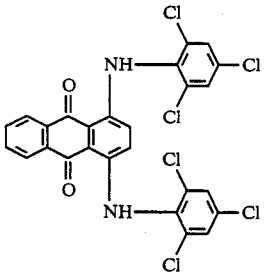
(I-36)
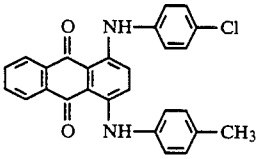
(I-37)
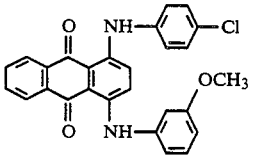
(I-38)
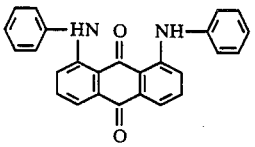
(I-39)
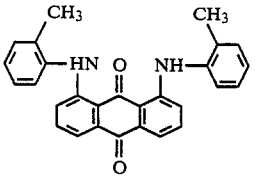
-continued
(I-40)
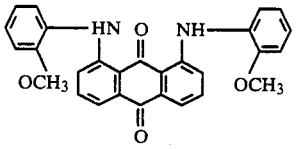
(I-41)
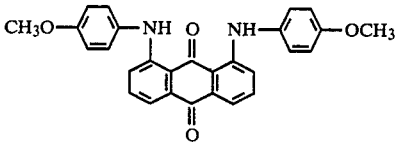
(I-42)
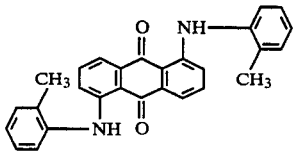
(I-43)
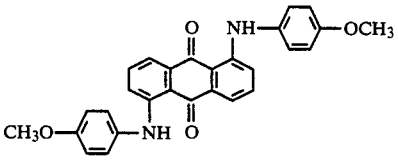
(I-44)
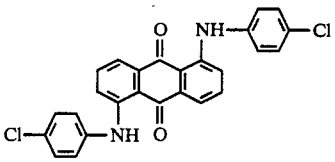
(I-45)
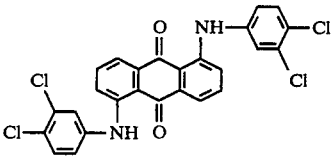
(I-46)
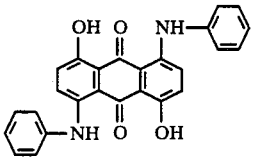
(I-47)
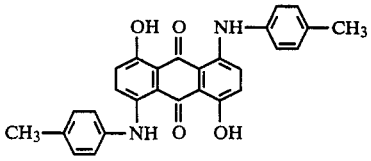
(I-48)
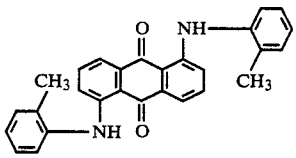

-continued
(I-49)
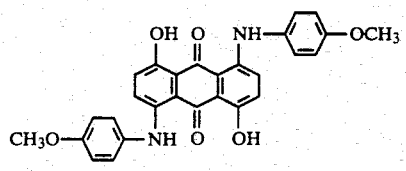
(I-50)
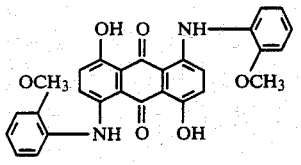
(I-51)
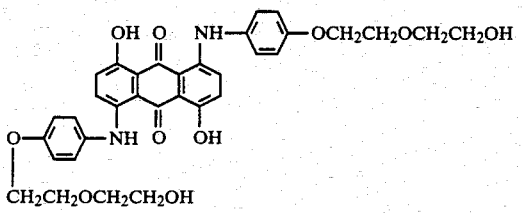
(I-52)
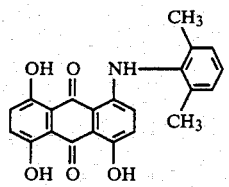
(I-53)
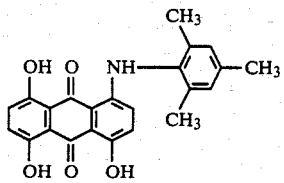
(I-54)
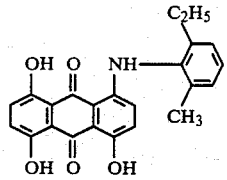
(I-55)
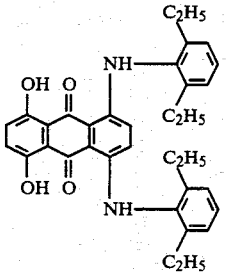
(I-56)
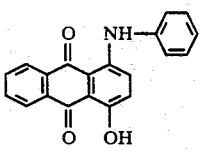
-continued
(I-57)
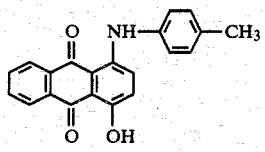
(I-58)
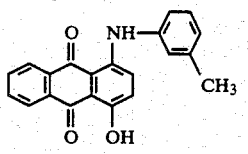
(I-59)
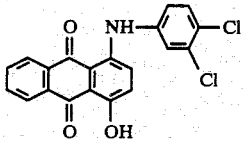
(I-60)
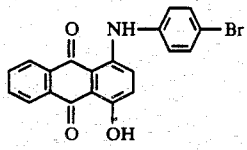
(I-61)
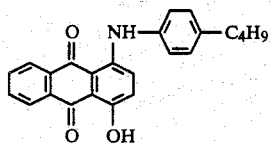
(I-62)
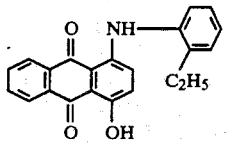
(I-63)
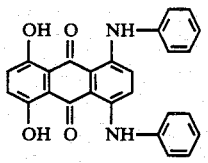
(I-64)
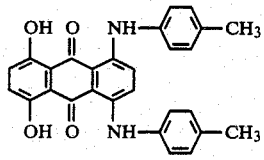
(I-65)
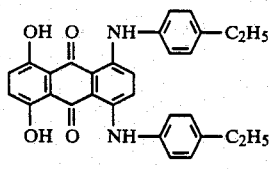

-continued
(I-66)
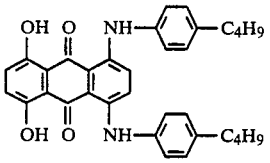
(I-67)
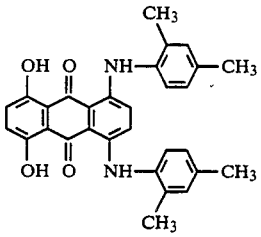
(I-68)
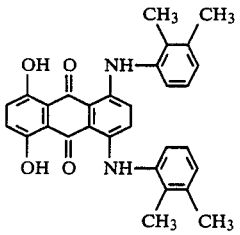
(I-69)
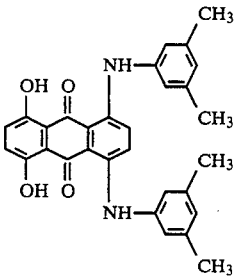
(I-70)
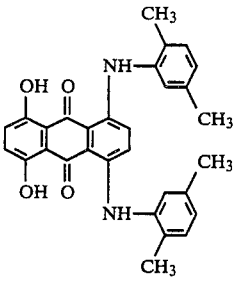
(I-71)
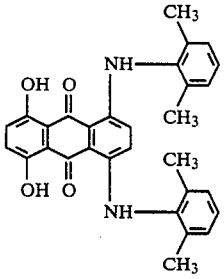
-continued
(I-72)
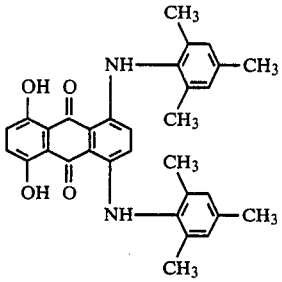
(I-73)
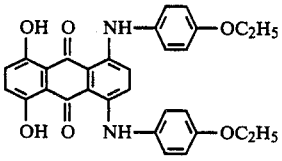
(I-74)
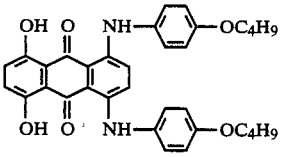
(I-75)
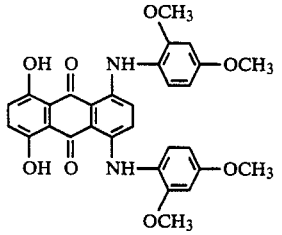
(I-76)
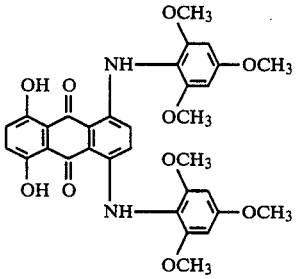
(I-77)
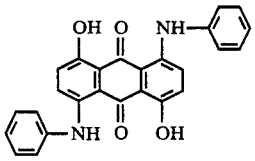
(I-78)
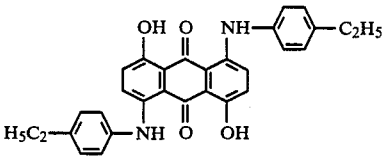

-continued
(I-79)
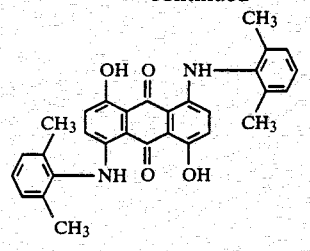
(I-80)
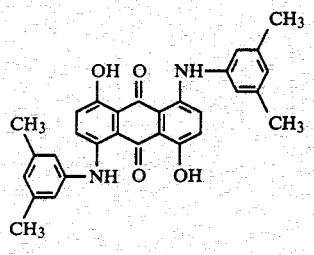
(I-81)
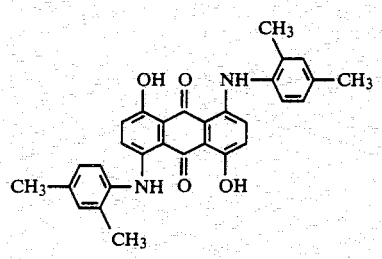
(I-82)
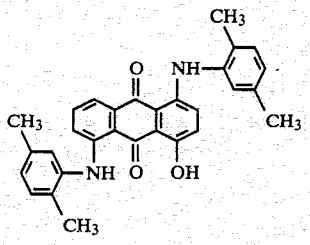
(I-83)
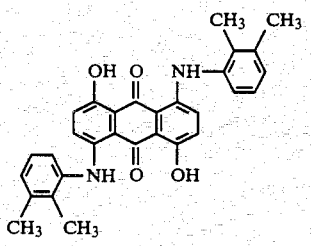
(I-84)
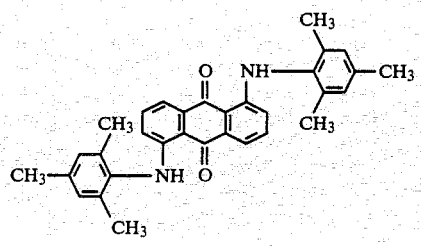
(I-85)
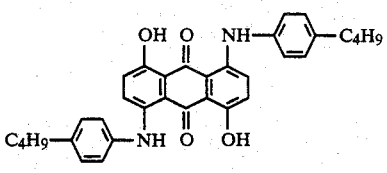
-continued
(I-86)
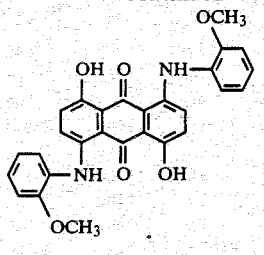
(I-87)
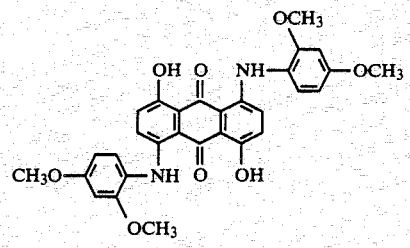
(I-88)
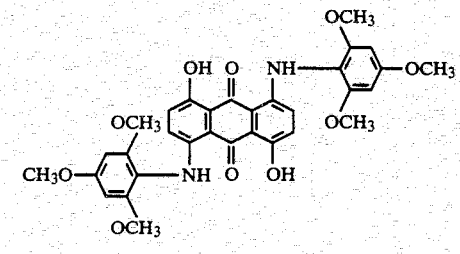
(I-89)
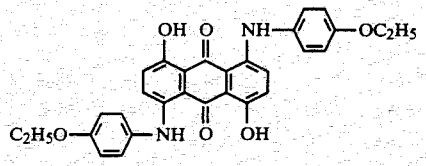
(I-90)
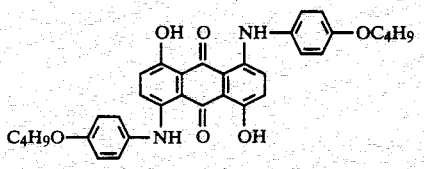
Specific examples of the cation portion of the compounds represented by formula (II) are listed below, to which the scope of the present invention are by no means limited.
$[(CH_3)_4N]^+$ (IIc-1)
$[(C_2H_5)_4N]^+$ (IIc-2)
$[(C_3H_7)_4N]^+$ (IIc-3)

-continued (IIc-4)

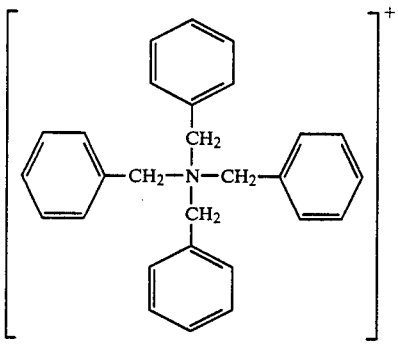

(IIc-5)

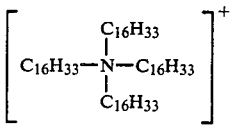

(IIc-6)

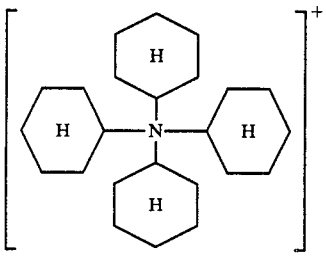

(IIc-7)

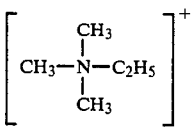

(IIc-8)

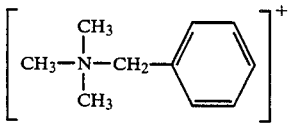

(IIc-9)

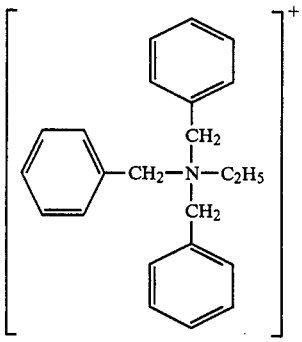

Specific examples of the anion portion of the compounds of formula (II) are listed below, to which the scope of the present invention are by no means limited.

(IIa-1) $R^{31}$ (IIa-2) $Cl^{31}$ (IIa-3) $Br^{31}$ (IIa-4) $OH^{31}$ (IIa-5) $CO_3^{31}$ (IIa-6) $OCOCH_3^{31}$ (IIa-7)

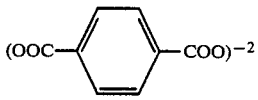

The above listed cation and anion portions may be combined in any manner to provide the compounds of formula (II), but it should again be noted that the scope of the present invention is by no means limited to the portions shown above.

The term "polyester" as used herein means a polyester that contains terephthalic acid and ethylene glycol as predominant acid and glycol components. Other acids and glycols may be used. Examples of other acids include isophthalic acid, naphthalene dicarboxylic acid, $\beta$-hydroxyethoxybenzoic acid, p-hydroxybenzoic acid, adipic acid and sebacic acids. These acid components may be used either alone or in combination. Illustrative glycols other than ethylene glycol include aliphatic, alicyclic and aromatic dioxy compounds such as trimethylene glycol, tetramethylene glycol, hexamethylene glycol and 1,4-cyclohexanediamethanol, as well as polyalkylene glycol such as polyethylene glycol. These glycol components may be used either alone or in combination. In any event, the polyester as used in the present invention is such that at least 80 mol% of the recurring units is composed of ethylene terephthalate. The polyester that is included without the definition above may be prepared by any of the conventional techniques that consist of the first reaction for producing bis-$\beta$-hydroxyethyl terephthalate or a polymer thereof having a small degree of polymerization, and the second reaction wherein the product of the first reaction is subjected to polycondensation. The first reaction is implemented by subjecting dimethyl terephthalate and ethylene glycol to ester exchange or by directly esterifying terephthalic acid and ethylene glycol. The catalysts used in the first reaction include calcium compounds, zinc compounds and manganese compounds, and those used in the second reaction include antimony, cobalt, germanium and titanium compounds. Phosphorus compounds may be used as stabilizers. Any compounds that may impart undesired colors to the polymer should be either avoided or used in minimal amounts so as not to polymerize the polymer.

The compound of formula (I) may be added at any stage of the process so long as it can be uniformly dissolved or dispersed. For instance, the compound may be added during the production of the polyester or it may be dusted over polyester pellets prior to melt forming. If desired, the compound may be added during the melt forming of the polyester by, for example, directly incorporating the necessary amount of colorant in polyester pellets or by diluting a preliminarily formed master batch resin concentrate with an uncolored resin. The compound may be added in amounts ranging from 50 to 1,000 ppm, preferably 100–500 ppm, with respect to the polyester. If the compound's amount is less than 50 ppm, the desired coloring effect is not obtained. If more than 1000 ppm of the compound is used, the transmission of substantially all of the incident light is blocked by the compound and the resulting film has low transparency and an undesired dark tone.

The quaternary ammonium salt of formula (II) may be added during or after the synthesis of polyester, and is preferably added during the polyester synthesis either in the first stage reaction of ester exchange or esterification or in the second stage for polycondensation. The quaternary ammonium salt may be added in amounts ranging frm 20 to 5,000 ppm, preferably 50–500 ppm, with respect to the polyester. The intended effect of the quaternary ammonium salt is not obtained if its amount is less than 20 ppm. Adverse stain effects occur if the ammonium salt is added in amounts exceeding 5,000 ppm. The ammonium salt may be added in the form of solutions in water or alcohols such as methanol and ethylene glycol.

The polyester in accordance with the present invention may incorporate inactive inorganic compounds such as kaolin, talc, calcium carbonate and amorphous silica in such small amounts that the transparency of the final film product will not be impaired. Antioxidants and antistat agents may also be incorporated in the polyester.

EXAMPLES

The following examples are provided for further illustration of the claimed polyester film and are in no way intended as limiting. In these examples, all parts are by weight. The following measurements were made of the samples prepared in the examples.

1. Intrinsic viscosity

Half a gram of a sample was dissolved in 50 ml of a phenol/tetrachloroethane (60/40 wt. ratio) mixture and the intrinsic viscosity of the solution was measured at 25° C.

2. Color difference between two films

The tones of two colored films 180 μm thick, one being undrawn and the other biaxially stretched and heat set, were determined by a double-beam full automatic color difference meter, Model TC-1500 MC of Tokyo Denshoku K.K., and the Hunter values of the films were calculated in accordance with the method of "Calculation of Color Difference by Hunter's Formula" specified in JIS Z 8730–1980. The color difference between two films, ΔEH, are calculated by the following equation:

$$EH = \sqrt{(\Delta L)^2 + (\Delta a)^2 + (\Delta b)^2}$$

wherein ΔEH: color difference as calculated by Hunter's color difference formula;

ΔL: the difference is psychometric brightness, L, between two film colors;

Δa, Δb: the differences between Hunter's a-value and b-value of two film colors.

3. Visual inspection of film's color tone

Each of the samples prepared was put on a viewing lantern (product of Seikosha K.K.) and the purity of the color of the film and its aesthetic appeal were visually checked.

EXAMPLES

A colorant and a quaternary ammonium salt selected from the compounds listed in Table 1 were incorporated in a polyester resin by the procedures described below and the resin was processed into a film by melt extrusion.

Polymerization

A mixture of ethylene glycol (70 parts) and dimethyl terephthalate (100 parts) was subjected to ester exchange by a conventional method using 0.09 part of calcium acetate monohydrate as a catalyst. After the addition of calcium acetate, 0.013 part of a quaternary ammonium salt was further added as a 10% aqueous solution. To the product of ester exchange, antimony trioxide (0.03 part) and phosphoric acid (0.04 part) were added and the mixture was subjected to polycondensation by a conventional method so as to produce a polyester resin having an intrinsic viscosity of 0.65.

Coloring

To 100 parts of the polyester resin, 0.027 part of a selected colorant was added.

The colored polyester resin was melted at 290° C. and processed by a conventional method to prepare an unstretched film. The film was stretched both longitudinally and transversally at a draw ratio of 3.3 at a temperature higher than the glass transition point, and the stretched film was heat set at 230° C. to make a film product having a thickness of 180μm. Unstretched films with the thickness of 180μm were also prepared as a reference for determination of color difference. Two other control samples were prepared by replacing the quaternary ammonium salt with an equal amount of triethylamine hydrochloride or tribenzylamine hydrobromide. The polyesters that contained both the quaternary ammonium salts and the compound represented by formula (I) in accordance with the present invention could be smoothly processed into films without any cases of breaking during the stretching operation. The compound was uniformly dispersed in the resulting films and its miscibility with the other film additives was good enough to eliminate the presence of any foreign matter. The characteristics of the films prepared are summarized in Table 1.

TABLE 1

| Sample No. | Compound of formula (I) | Quaternary ammonium salt | Color difference between undrawn film and stretched and heat set film, ΔEH | Appearance of stretched and heat set film | Remarks |
|---|---|---|---|---|---|
| 1 | I - 7 | — | 2.6 | poor | A |
| 2 | | IIc-1, $Br^-$ | 0.3 | good | B |
| 3 | I - 7 | — | 2.6 | poor | A |
| 4 | | IIc-6, $F^-$ | 0.2 | good | B |
| 5 | I - 7 | — | 2.3 | poor | A |
| 6 | | IIc-2, $OH^-$ | 0.2 | good | B |
| 7 | I - 12 | — | 2.5 | poor | A |
| 8 | | IIc-3, $OH^-$ | 0.3 | good | B |
| 9 | I - 43 | — | 2.9 | poor | A |
| 10 | | IIc-7, $Cl^-$ | 0.4 | good | B |
| 11 | I - 7 | — | 2.6 | poor | A |
| 12 | | triethylamine hydrochloride | 1.8 | poor | A |

TABLE 1-continued

| Sample No. | Compound of formula (I) | Quaternary ammonium salt | Color difference between undrawn film and stretched and heat set film, ΔEH | Appearance of stretched and heat set film | Remarks |
|---|---|---|---|---|---|
| 13 | I - 89 | — | 3.0 | poor | A |
| 14 | | tribenzylamine hydrobromide | 2.0 | poor | A |

A: comparative sample
B: sample of the present invention

As the data in Table 1 show, the films prepared in accordance with the present invention had no color change that was introduced during the film making operation, and the color of these films had good purity and aesthetic appeal. On the other hand, the control films had a low color purity and most of them were tinged with unseemly yellowishness.

Advantages of the Invention

In accordance with the present invention, a colored polyester film adapted for use as X-ray photographic film supports can be produced by melt forming a blue or bluish purple colored polyester into a film without experiencing color variations at any stage of the film forming operation.

What is claimed is:

1. A support for photographic use comprizing a polyester film containing at least one compound of the following formula (I) and at least one quaternary ammonium salt of the following formula (II):

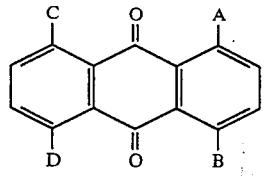

(I)

(wherein A is 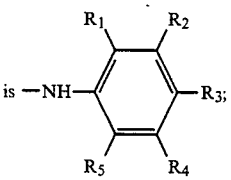 ;

B, C and D are each 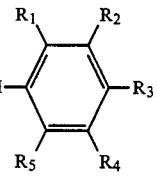

a hydroxyl group, a nitro group, an amino group or a hydrogen atom; $R_1$, $R_2$, $R_3$, $R_4$ and $R_5$ are each a hydrogen atom, a halogen atom, an alkoxy group, an alkyl group, an aryloxy group, an aralkoxy group, a hydroxyalkyl group, $-(OCH_2)_mOH$ (m is an integer or 1 to 4) or

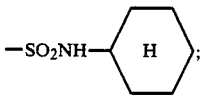

B, C and D are not simultaneously at least one member selected from the group consisting of a hydrogen atom, a nitro group and an amino group);

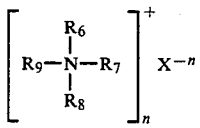

(II)

(wherein $R_6$, $R_7$, $R_8$ and $R_9$ are each an alkyl group, an aralkyl group or an allyl group; X is an anion; and n represents the number of charges on X).

2. A support according to claim 1, wherein said support is an X-ray photographic film support.

3. A support according to claim 1, wherein said polyester has at least 80 mol% of ethylene terephthalate in the recurring units in the molecule.

4. A support according to claim 1, wherein said compound represented by formula (I) is added in an amount of 50 to 1,000 ppm with respect to the polyester.

5. A support according to claim 4, wherein the amount of said compound to be added is 100 to 500 ppm.

6. A support according to claim 1, wherein said quaternary ammonium salt represented by formula (II) is added in an amount of 20 to 5,000 ppm with respect to the polyester.

7. A support according to claim 6, wherein the amount of said quaternary ammonium salt to be added is 50 to 500 ppm.

* * * * *